United States Patent [19]

Anderson et al.

[11] 4,144,717

[45] Mar. 20, 1979

[54] DUAL FLASH ECONOMIZER REFRIGERATION SYSTEM

[75] Inventors: Carl M. Anderson, Syracuse; Louis H. Leonard, DeWitt, both of N.Y.

[73] Assignee: Carrier Corporation, Syracuse, N.Y.

[21] Appl. No.: 828,458

[22] Filed: Aug. 29, 1977

[51] Int. Cl.[2] ..... F25B 5/00; F25B 31/00; F25B 1/10

[52] U.S. Cl. ..... 62/117; 62/199; 62/505; 62/510

[58] Field of Search ..... 62/115, 117, 174, 219, 62/238, 476, 498, 504, 505, 510, 512

[56] References Cited

U.S. PATENT DOCUMENTS

| | | | |
|---|---|---|---|
| 2,277,647 | 3/1942 | Jones | 62/115 |
| 2,684,579 | 7/1954 | Hieatt et al. | 62/462 |
| 3,165,905 | 1/1965 | Ware | 62/505 |
| 3,226,940 | 1/1966 | Jekat et al. | 62/199 |
| 3,232,074 | 2/1966 | Weller et al. | 62/505 |
| 3,553,974 | 1/1971 | Osborne | 62/115 |
| 3,665,724 | 7/1954 | Hieatt et al. | 62/468 |
| 4,014,182 | 3/1977 | Granryd | 62/117 |

*Primary Examiner*—Lloyd L. King

*Attorney, Agent, or Firm*—J. Raymond Curtin; Robert P. Hayter

[57] ABSTRACT

A vapor compression refrigeration system which has a compressor, a condenser, a flash economizer and an evaporator to form a primary refrigerant loop and a second compressor and an economizer-condenser which partially form a secondary refrigerant loop. Gaseous refrigerant from the flash economizer is recompressed in the second compressor and thereafter recondensed by the economizer-condenser. The recondensed refrigerant is then flashed in the flash economizer further cooling the liquid refrigerant therein.

15 Claims, 3 Drawing Figures

DUAL FLASH ECONOMIZER REFRIGERATION SYSTEM

BACKGROUND OF THE INVENTION

1. Field of the Invention

The present invention relates to vapor compression refrigeration systems which are adapted to cool a fluid for domestic or other uses. More particularly, the present invention relates to a vapor compression refrigeration system with two compressors, the second compressor receiving flashed gaseous refrigerant from a flash economizer and recompressing the gaseous refrigerant so that it may be used within the refrigeration system for absorbing heat from the fluid to be cooled.

2. Description of the Prior Art

Refrigeration systems of the vapor compression type typically employ a compressor to increase the temperature and pressure of a gaseous refrigerant. Connected thereto is a condenser wherein the gaseous refrigerant is sufficiently cooled to change state to a liquid refrigerant. Thereafter the refrigerant may be subcooled in a flash economizer wherein part of the refrigerant is vaporized absorbing heat from the remaining liquid refrigerant. The vaporized refrigerant has been typically drawn into the compressor for recycling through the condenser and the liquid refrigerant which has now been cooled passes on to the evaporator or chiller. In the chiller, the refrigerant is evaporated absorbing heat from the fluid to be cooled, the now gaseous refrigerant being drawn into the compressor to complete the cycle. In the above described refrigeration system, the compressor is a multistage compressor such that the flashed refrigerant from the flash economizer may be drawn into the compressor between the stages allowing the flash economizer to be at an intermediate pressure to the condenser and the chiller.

The basic patent dealing with a flash economizer was issued to Jones in 1942 and is entitled "Refrigeration", U.S. Pat. No. 2,277,647. Therein the flash economizer was located between the condenser and the evaporator and the flashed gaseous refrigerant therefrom was drawn into the compressor between the first and second stages and the liquid refrigerant which has been cooled in the flashing process is allowed to travel to the evaporator.

Other types of multi-stage compressors have been used with various economizers. In Weller, et al., U.S. Pat. No. 3,232,074, entitled "Cooling Means for a Dynamoelectric Machine" there is disclosed an evaporator and a condenser wherein the flash economizer is located therebetween, the flash gas being drawn into the second stage of a two stage compressor and the liquid refrigerant passing through the condenser and to the machine for cooling of the electric motor. Other typical economizers are shown in Ware, U.S. Pat. No. 3,165,905; in Osborne, U.S. Pat. No. 3,553,974; in Hieatt, et al., U.S. Pat. No. 2,648,579; and in Anderson, et al., U.S. Pat. No. 3,655,724.

In Jeket, U.S. Pat. No. 3,226,940 an economizer is used with a centrifugal compressor having a combination impeller blade such that the flashed gas from the economizer may enter the centrifugal compressor in the middle of the blade thereby creating within a single compressor two separate pressure levels. In Granryd, U.S. Pat. No. 4,014,182 a method and apparatus are disclosed wherein an economizer is utilized with a single stage compressor such that liquid refrigerant is allowed to flow from the condenser to the economizer wherein gaseous refrigerant is withdrawn into the compressor until such time as the economizer temperature reaches the desired level. At such time a valve opens allowing the refrigerant to be drawn into the chiller from which the compressor removes the flashed refrigerant gas. The compressor runs continuously, however, the suction line to the compressor is cycled alternately between the economizer and the condenser such that the compressor is always withdrawing refrigerant from either the economizer or the condenser and such that the refrigerant passing from the economizer to the condenser is always at the desired temperature.

In order to use a flash economizer in an existing single stage compressor vapor compression system it is necessary that a second compressor be provided such that the flash gas can be compressed. Thereafter by providing an economizer-condenser this recompressed flashed gas may be condensed to a liquid and may be reflashed to further cool itself and the liquid from the initial flashing process. This system is particularly applicable to refrigerants such as R-11 which are not adaptable to sensible heat sub-cooling. Consequently, latent heat cooling by means of a change of state is the only practical method to subcool R-11 and other similar refrigerants.

Prior refrigeration systems utilizing a flash economizer have required a multiple stage compressor to provide varying pressure levels for the flashing to occur. Refrigeration systems with a single stage compressor have previously not been adaptable for retrofit machinery to provide a flash economizing step since the pressure differential required has not been obtainable. The refrigeration system described hereafter is adaptable to be retrofitted to a single stage centrifugal compressor system so that a second compressor may be provided to recompress the flashed gas from the flash economizer. The provision of an economizer-condenser which would condense the recompressed flashed gas aids the overall efficiency of the system.

For similar refrigeration systems see the U.S. patent application filed herewith entitled Dual Flash and Thermal Economized Refrigeration System, Ser. No. 828,793.

SUMMARY OF THE INVENTION

An object of the present invention is to provide an efficient refrigeration system.

A more specific object of the present invention is to provide a dual flash economized refrigeration system.

Another object of the present invention is to provide a vapor compression refrigeration system wherein the refrigerant is flashed for subcooling and thereafter part of the refrigerant is recompressed and recondensed for additional subcooling.

It is another object of the present invention to cool liquid refrigerant such that the overall efficiency of a refrigeration system will be increased.

It is another object of the present invention to recondense recompressed refrigerant such that the recondensed refrigerant may be flashed a second time to subcool the liquid refrigerant.

It is a still further object of the present invention to provide a flash economizer system which may be incorporated into an existing vapor compression refrigeration system utilizing a single stage centrifugal compressor.

It is a further object of the present invention to utilize the coldest available condensing water first in the economizer-condenser and then in the main condenser.

Other objects will be apparent from the description to follow and from the appended claims.

The preceding objects are achieved according to a preferred embodiment of the invention by the provision of a flash economizer within a single stage vapor compression refrigeration system. Therein the condenser is connected to a compressor, the condenser condensing the gaseous refrigerant received from the compressor to a liquid refrigerant. A flash economizer receives liquid refrigerant from the condenser and flashes that refrigerant such that part of the refrigerant changes state to a gas absorbing heat from the remaining liquid refrigerant. The liquid refrigerant then travels to the evaporator where it changes state from a liquid to a gas absorbing heat from the fluid to be cooled. The gaseous refrigerant from the evaporator is then transported to the compressor where it is recompressed to start the cycle again. The flashed gas from the step of flash economizing is recompressed in a second compressor. The recompressed gas is then condensed in an economizer-condenser to the liquid state. The liquid refrigerant therefrom is flashed through an orifice into the flash economizer from which the liquid refrigerant is allowed to travel to the evaporator and the gaseous refrigerant is again conducted to the second compressor.

DESCRIPTION OF THE PREFERRED EMBODIMENT

The embodiment of the invention described below is adapted for use in a vapor compression refrigeration system having a single stage compressor, a condenser, and an evaporator. It is to be understood that the present invention finds applicability in refrigeration systems other than single stage vapor compression systems. The present invention is further adapted so that multiple condensers are available within a single refrigeration system. These multiple condensers may be used as disclosed herein or in other types of refrigeration systems.

Figures 1, 2:
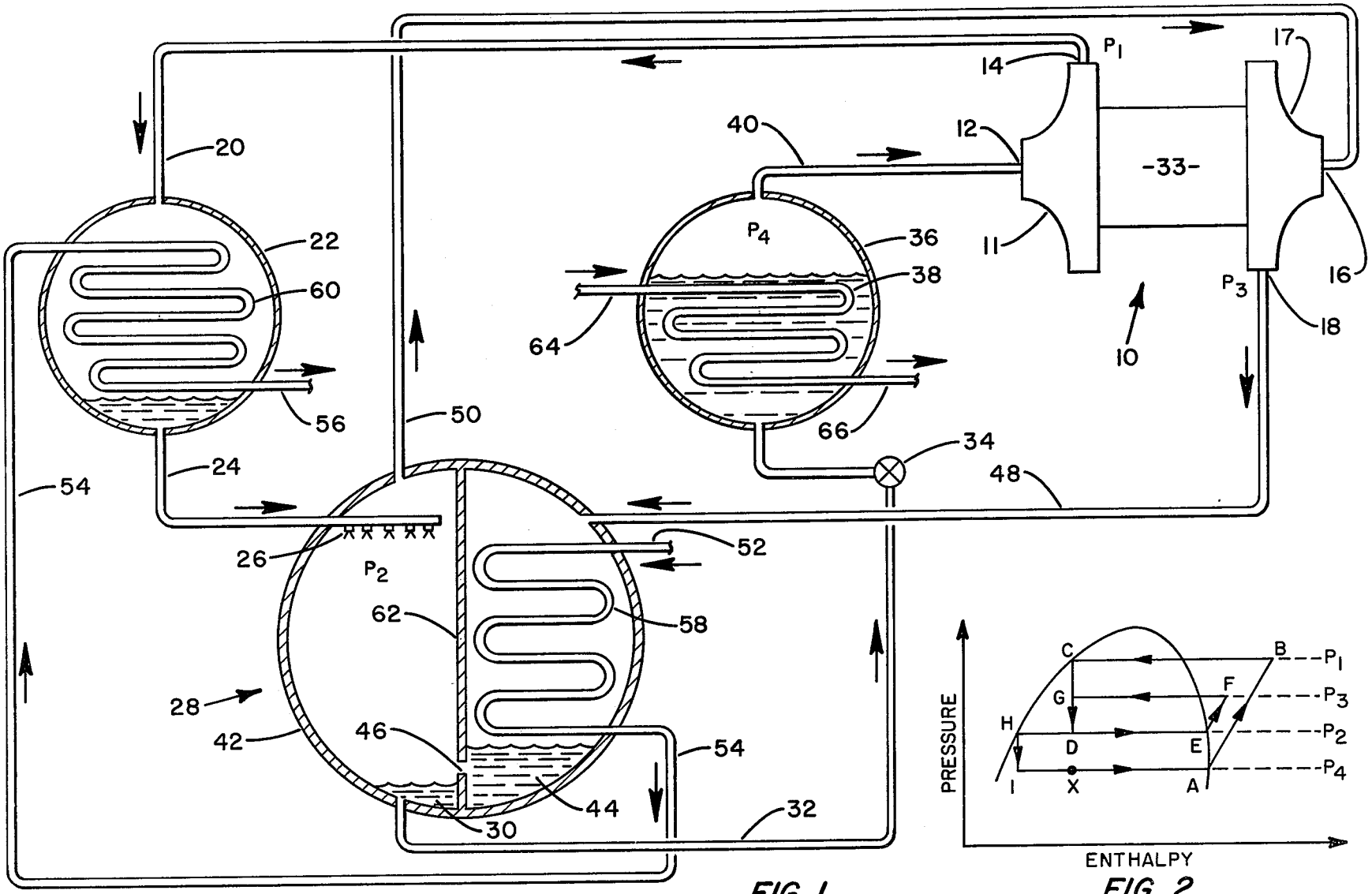
FIG. 1 is a schematic diagram of a vapor compression refrigeration system utilizing the present invention.
FIG. 2 is a pressure enthalpy graph showing the refrigeration cycle of the present invention.

Referring to FIG. 1, a schematic drawing of a vapor compression refrigeration system, it can be seen that a dual channel compressor 10 is provided having two separate centrifugal compressors 11 and 17 located on a single axis driven by an electric motor 33. A primary compressor 11 has increased temperature and pressure refrigerant gas exiting therefrom at outlet 14 into line 20. From line 20, the gaseous refrigerant enters condenser 22 wherein it changes state to a liquid refrigerant. Liquid refrigerant is collected in the bottom of condenser 22 and then transported through line 24 to flash economizer 28. In the flash economizer liquid refrigerant is flashed through nozzles 26 such that part of the refrigerant changes state to a gas, absorbing heat from the remaining liquid refrigerant. Liquid refrigerant collects at the bottom of the flash economizer shown as reservoir 30. Therefrom via line 32 liquid refrigerant passes to expansion control device 34 wherein the pressure of the liquid refrigerant is dropped. From the expansion control device the liquid refrigerant travels to chiller 36 wherein the liquid changes state to a gas, absorbing heat from the fluid to be cooled as it passes through the chiller. Line 40 then conducts the gaseous refrigerant from the chiller to inlet 12, the inlet to the compressor 11 wherein the gaseous refrigerant is recompressed to begin the refrigeration cycle again.

Within chiller 36 is located a coil 38 through which refrigerant flows. Water or other fluid to be cooled enters chiller 36 through line 64 and then typically floods over coils 38 in heat exchange relationship therewith. The now cooled water exits through the line 66 to the enclosure to be cooled.

Connected to flash economizer 28 is line 50 which conducts the gaseous refrigerant to inlet 16 of compressor 17. Both compressor 11 and compressor 17 are driven by electric motor 33. Therein compressor 17 increases the temperature and pressure of the flashed refrigerant gas and delivers the recompressed gas to outlet 18. This recompressed gas travels through line 48 to economizer-condenser 42 wherein the recompressed gas is recondensed into a liquid. The liquid is collected in reservoir 44 such that it may be flashed from the economizer-condenser to the flash economizer through orifice 46. The flashed refrigerant from orifice 46 travels upward and is conducted through line 50 back to the second compressor. The liquid refrigerant from orifice 46 is collected in reservoir 30 and it travels to the chiller 36. Entering condensing water travels through line 52 through coils 58 of economizer-condenser 42 through lines 54 through condenser 22 and therein through coil 60 to exiting condenser water line 56. The condensing water picks up heat in the economizer-condenser and then picks up additional heat in the main condenser 22.

Compressor 11 increases the pressure of the gaseous refrigerant to $P_1$. Thereafter the pressure of the refrigerant is decreased in the flash economizer to $P_2$. The second compressor increases the pressure of the flashed gaseous refrigerant from $P_2$ to $P_3$, the economizer-condenser condensing refrigerant at the $P_3$ pressure. From the reservoir of liquid refrigerant 44, liquid refrigerant at pressure $P_3$ is then flashed to the lower pressure $P_2$ through orifice 46. Expansion control device 34 allows the pressure to drop from $P_2$ to $P_4$ for cycling through chiller 36. Refrigerant enters inlet 12 at $P_4$ and is thereafter increased to $P_1$ by compressor 11.

FIG. 2 is a graph of pressure vs. enthalpy for a typical refrigerant such as R-11 which is used within this system. Starting at Point A thereon it can be seen that the pressure and enthalpy of the refrigerant is increased from Point A to Point B, said distance representing the change in pressure and enthalpy due to compressor 11. From Point B to Point C represents the change in enthalpy in condenser 22 as the gaseous refrigerant changes state to a liquid refrigerant. Thereafter in the flash economizer the refrigerant travels from Point C to Point D, representing the pressure decrease as the refrigerant is flashed. From Point D the liquid refrigerant is cooled to Point H and the gaseous refrigerant travels to Point E absorbing heat from the now cooled liquid refrigerant. The distance from Point E to Point F represents the increase in enthalpy and pressure as the gaseous refrigerant is compressed in the second compressor. The distance from Point F to Point G represents the recondensing of the recompressed refrigerant in the economizer-condenser. The distance from Point G to Point D represents the decrease in pressure as the liquid refrigerant is flashed through orifice 46 from the economizer-condenser to the flash economizer. The distance from Point H to Point I represents the pressure drop through expansion control device 34 and the distance from Point I back to the original Point A represents the change in enthalpy that occurs in the chiller when heat is absorbed from the liquid to be cooled. As can be seen in FIGS. 1 and 2, $P_1$, $P_2$, $P_3$ and $P_4$ are indicated on both showing the respective pressure relationships.

In a pressure-enthalpy diagram the left portion of the curve indicates the pressure-enthalpy line at which the liquid refrigerant is 100% saturated and the right side of the curve indicates pressure enthalpy line when gaseous refrigerant is 100% saturated. The area between the two lines indicates a two phase mixture of liquid and vapor.

In order to obtain the most cooling work from a given amount of refrigerant it is desirable to cool the refrigerant as close as possbile to the left side of the curve such that when the refrigerant is flashed in the chiller as much heat as possible, proportional to the distance from I to A, is absorbed from the refrigerant to be cooled. Without the flash economizer, it is obvious that the heat available to be absorbed by the refrigerant is proportional to that distance represented in the graph from X to A, X being that point to which the refrigerant would travel from point C if the pressure were dropped to $P_4$ in one step. By the provision of the flash economizer the refrigerant is cooled to Point H allowing the heat to be absorbed from the refrigerant to be cooled to be increased to the distance indicated by the line from I to A. This increase in the length from distance XA to distance IA represents an overall efficiency increase in the amount of heat that may be absorbed in the refrigeration system.

For optimization of thus dual economized refrigeration system, the entering condensing water is circulated first through the economizer-condenser and then through the main condenser 22. The economizer-condenser operates at a temperature considerably lower than the main condenser and consequently the cooling water is advantageously used by circulating first through the economizer-condenser and then through the main condenser. Of course, additional condensing water may be supplied to the main condenser to meet the load thereon.

Flash economizer 28 is shown mounted within half of a cylinder in FIG. 1. The other half of the cylinder contains an economizer-condenser and reservoir 44 of liquid refrigerant. The cylinder is divided by center plate 62 into the flash economizer and the economizer-condenser which operates at separate pressures from the economizer-condenser 42 to the flash economizer 28. Refrigerant travels through orifice 46 which is a small opening within center plate 62. This physical arrangement is described merely to indicate that the flash economizer and economizer-condenser may be fitted within a portion of a conventional refrigeration machine utilizing cylindrical pressurized compartments.

The preferred embodiment above described has shown an improved vapor compression refrigeration system utilizing two compressors to increase the efficiency of operation of a refrigeration system. Particularly the system has been shown which may be adapted to be used with the previously installed single stage vapor compression refrigeration system to increase the efficiency thereof.

Figure 3:
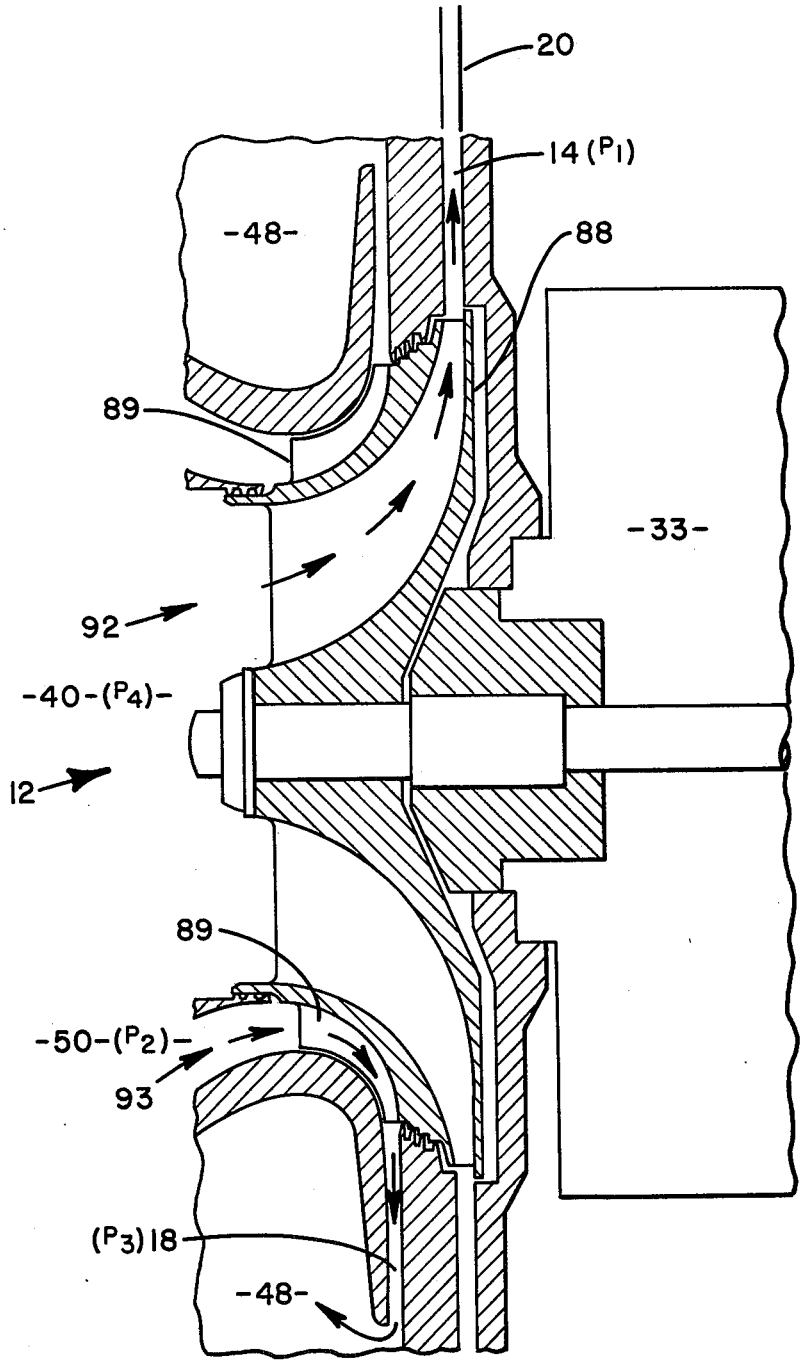
FIG. 3 is a schematic diagram of a "piggyback" compressor for use with the refrigeration system of FIG. 1.

Referring now to FIG. 3, a schematic drawing of a "piggyback" compressor, it can be seen that this "piggyback" compressor may be advantageously utilized within the above described vapor compression refrigeration system. A motor 33 is mounted to drive primary impeller 88 and secondary impeller 89. The secondary impeller is mounted to primary impeller 88 such that when the motor drives the primary impeller, the secondary impeller will also be driven. However, the secondary impeller is mounted on the primary impeller in such a manner that the flow paths of the refrigerant being compressed by the primary impeller and the secondary impeller are separated by cover or shroud 91 of the primary impeller. The primary impeller is a closed type impeller since shroud 91 is located thereon. The word "piggyback" in reference to this compressor refers to the face that the secondary impeller is mounted to the primary impeller such that when one operates the other operates. The schematic diagram shown in FIG. 3 is designed to be compatible with the system shown in FIG. 2 having the "piggyback" compressor of FIG. 3 substituted for the dual compressors of FIG. 1.

As shown in FIG. 3, the primary impeller 88 receives refrigerant at pressure $P_4$ through conduit 40 at inlet 12. The refrigerant then proceeds along the primary flow path 92 and has its temperature and pressure increased as it flows along said path. The now increased temperature and pressure refrigerant is discharged at outlet 14 into conduit 20 at pressure $P_1$. Simultaneously therewith, refrigerant is received through conduit 50 into inlet 16 at pressure $P_2$. The refrigerant enters the secondary impeller through inlet 16 and travels along secondary flow path 93. The refrigerant is then discharged from secondary impeller 89 through outlet 18 into conduit 48, the refrigerant pressure then being at $P_3$.

Referring now to the combination of FIGS. 2 and 3, it can be seen that the refrigerant entering the primary impeller through conduit 40 is the flashed gaseous refrigerant coming from chiller 36. The refrigerant being discharged from primary impeller 88 into conduit 20 travels to the condenser 22. The refrigerant received from conduit 50 at pressure $P_2$ is the flashed gaseous refrigerant from the flash economizer 28. The refrigerant being discharged through outlet 18 into conduit 48 from the secondary impeller travels to the economizer-condenser. As can be seen from the above description, the "piggyback" compressor may be substituted for the dual channel compressor shown in FIG. 2.

The invention has been described in detail with particular reference to a preferred embodiment thereof but it will be understood that variations and modifications can be effected within the spirit and the scope of the invention.

What is claimed is:

1. A vapor compression refrigeration system using a refrigerant for cooling a fluid which comprises:

a first compressor for increasing the temperature and pressure of the gaseous refrigerant;

a condenser connected to the first compressor wherein the refrigerant is cooled to change state from a gas to a liquid;

a flash economizer connected to the condenser in which liquid refrigerant is partially flashed, the flashed refrigerant absorbing heat from the remaining liquid refrigerant;

a second compressor connected to the flash economizer so that the flash refrigerant from the economizer is drawn into the compressor where the temperature and pressure of the flashed refrigerant is increased;

an economizer-condenser connected to the second compressor for changing the state of the flashed refrigerant from a gas to a liquid;

means connected to the economizer-condenser for flashing the liquid refrigerant therefrom in the flash economizer; and a chiller for cooling the fluid, said chiller receiving liquid refrigerant from the flash economizer and discharging gaseous refrigerant to the first compressor.

2. The invention as set forth in claim 1 wherein the means for flashing the economizer-condenser refrigerant is an orifice opening connecting the economizer-condenser to the flash economizer.

3. The invention as set forth in claim 2 wherein the flash economizer and the economizer-condenser are contained within a cylindrical shell divided by a center plate into two portions, one portion for the economizer-condenser and one portion for the flash economizer, said center plate having an orifice therein to allow liquid refrigerant from the economizer-condenser to flash into the flash economizer.

4. The invention as set forth in claim 1 wherein the first compressor is the primary channel of the dual channel centrifugal compressor and the second compressor is the secondary channel of the same dual channel centrifugal compressor.

5. The invention as set forth in claim 1 wherein the economizer-condenser and the main condenser are cooled by condensing water which is circulated in series through the economizer-condenser and then through the main condenser so that the economizer-condenser receives the condensing water, when it is coldest.

6. A vapor compression refrigeration system utilizing a refrigerant for cooling a fluid which comprises:

a primary refrigerant loop having:

(a) a first compressor for discharging gaseous refrigerant at an increased temperature and pressure;

(b) a condenser connected to receive the refrigerant from the compressor wherein the refrigerant is converted from a gas to a liquid;

(c) a flash economizer connected to the condenser wherein the liquid refrigerant is partially flashed to the gaseous state absorbing heat from the remaining liquid refrigerant;

(d) an expansion control device connected to receive liquid refrigerant from the flash economizer wherein refrigerant pressure is reduced;

(e) a cooler that receives refrigerant from the expansion control device and discharges said refrigerant to the first compressor, at least part of said refrigerant changing state from a liquid to a gas therein to absorb heat from the fluid to be cooled; and a secondary refrigeration loop having:

(a) a second compressor connected to receive flashed gaseous refrigerant from the flash economizer;

(b) an economizer-condenser connected to receive gaseous refrigerant from the second compressor wherein the state of the refrigerant is changed from a gas to a liquid;

(c) flashing means in communication with the primary refrigeration loop and the liquid refrigerant from the economizer-condenser to discharge refrigerant into the primary refrigeration loop from the secondary refrigeration loop, the liquid refrigerant being conducted to the expansion control device and the gaseous refrigerant being conducted to the second compressor.

7. The invention as set forth in claim 6 wherein the first compressor and the second compressor comprise a single centrifugal compressor having dual channels, one channel for the primary loop and one channel for the secondary loop.

8. The invention as set forth in claim 6 wherein the economizer-condenser and the condenser are both cooled by cooling water, said cooling water flowing first to the economizer-condenser and then to the main condenser.

9. The invention as set forth in claim 6 wherein flashing means comprises an orifice connected to the liquid refrigerant in the economizer-condenser and to the flash economizer whereby liquid refrigerant from the economizer-condenser, at a higher pressure than the flash economizer, passes through the orifice, part of said refrigerant changing from a liquid to a gas absorbing heat from the remaining liquid refrigerant.

10. A flash gas refrigeration loop for use with a refrigeration system having a flash economizer and an evaporator through which refrigerant circulates which comprises:

a compressor connected to receive gaseous refrigerant from the flash economizer;

an economizer-condenser connected to receive hot gaseous refrigerant from the compressor wherein said refrigerant is cooled so that it changes from a gas to a liquid; and flashing means through which liquid refrigerant is passed, at least part of said refrigerant changing state from a liquid to a gas and absorbing heat from the remaining liquid refrigerant, the gaseous refrigerant being conducted to the compressor and the liquid refrigerant being conducted to the evaporator.

11. A method of cooling a fluid within a refrigeration system utilizing a refrigerant which comprises:

compressing the gaseous refrigerant to increase its temperature and pressure;

condensing the gaseous refrigerant to a liquid refrigerant;

flashing the refrigerant so that part of the liquid refrigerant changes from a liquid to a gas absorbing heat from the remaining liquid refrigerant;

recompressing the gaseous refrigerant created by the step of flashing;

recondensing the recompressed refrigerant;

reflashing the recondensed refrigerant so that part of the recondensed refrigerant changes state to a gas absorbing heat from the remaining liquid refrigerant;

lowering the pressure of the liquid refrigerant below the pressure at the steps of flashing and reflashing;

evaporating the liquid refrigerant in a heat exchanger to absorb heat from the liquid to be cooled, wherein the refrigerant changes state to a gas so it may be cycled to the step of compressing.

12. A vapor compression refrigeration system using a refrigerant for cooling a fluid which comprises:

a compressor system having a primary impeller for increasing the temperature and pressure of the refrigerant and a secondary impeller mounted to the primary impeller but having a separate flow path therefrom also for increasing the temperature and pressure of the refrigerant;

a condenser connected to receive increased temperature and pressure refrigerant from the primary impeller wherein the refrigerant is cooled to change state from a gas to a liquid;

a flash economizer connected to the condenser in which liquid refrigerant is partially flashed, the flashed refrigerant absorbing heat from the remaining liquid refrigerant;

connecting means connected to the flash economizer and the secondary impeller so that the flashed refrigerant from the economizer is drawn into the secondary impeller where the temperature and pressure of the flashed refrigerant is increased;

an economizer-condenser connected to receive the increased temperature and pressure refrigerant from the secondary impeller wherein the flashed refrigerant changes state from a gas to a liquid;

means connected to the economizer-condenser for flashing the liquid refrigerant therefrom in the flash economizer; and a chiller for cooling the fluid, said chiller receiving liquid refrigerant from the flash economizer and discharging gaseous refrigerant to the primary impeller.

13. The invention as set forth in claim 12 wherein the means for flashing the economizer condenser refrigerant is an orifice connecting the economizer-condenser to the flash economizer.

14. The invention as set forth in claim 13 wherein the flash economizer and the economizer-condenser are contained within a cylindrical shell divided by a center plate into two portions, one portion for the economizer condenser and one portion for the flash economizer, said center plate having an orifice therein to allow refrigerant from the economizer-condenser to flash into the flash economizer.

15. The invention as set forth in claim 12 wherein the primary impeller and the secondary impeller are both driven by a single motor.

* * * * *